United States Patent [19]

Heynisch

[11] 4,358,705

[45] Nov. 9, 1982

[54] SUPPORTING SYSTEM FOR THE DELAY LINE OF A TRAVELLING WAVE TUBE

[75] Inventor: Hinrich Heynisch, Graefelfing, Fed. Rep. of Germany

[73] Assignee: Siemens Aktiengesellschaft, Berlin & Munich, Fed. Rep. of Germany

[21] Appl. No.: 202,611

[22] Filed: Oct. 31, 1980

[30] Foreign Application Priority Data

Jan. 31, 1980 [DE] Fed. Rep. of Germany ..... 3003530

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,806,170 | 9/1957 | Bianculli | 315/3.5 |
| 2,933,637 | 4/1960 | Bruck et al. | 315/3.5 |
| 2,943,228 | 6/1960 | Kleinman | 315/3.5 |
| 3,209,198 | 9/1965 | Long et al. | 315/3.5 |
| 3,271,615 | 9/1966 | Washburn, Jr. | 315/3.5 |
| 3,435,273 | 3/1969 | Kennedy | 315/3.5 |
| 3,895,326 | 7/1975 | Hinckeldey et al. | 315/3.5 |
| 4,270,070 | 5/1981 | Gross | 315/3.5 |

*Primary Examiner*—Saxfield Chatmon, Jr.

*Attorney, Agent, or Firm*—Hill, Van Santen, Steadman, Chiara & Simpson

[57] ABSTRACT

A supporting system for a delay line of a travelling wave tube wherein a number of clamping rings press dielectric support rods against the delay line. The clamping rings have a natural length along the delay line and a spacing distance such that $(N \cdot w\lambda)/4 = L_{1,2}$, where $L_{1,2}$ designates the length of the line resonators, $\lambda_w$ the wave length on the delay line, and N a whole uneven number.

3 Claims, 1 Drawing Figure

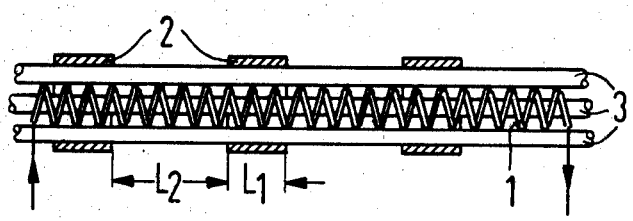
2
3
L2
L1
1

SUPPORTING SYSTEM FOR THE DELAY LINE OF A TRAVELLING WAVE TUBE

BACKGROUND OF THE INVENTION

The invention relates to a supporting system for a helical or ring-bar delay line of a travelling wave tube wherein the delay line is supported by a number of dielectric support rods which are arranged parallel to one another along generating lines of the line, and wherein a number of clamping rings which consist of resilient material and press the support rods against the delay line are provided.

Travelling wave tubes with helical delay lines are generally known from U.S. Pat. Nos. 3,506,872; 3,863,092; and 3,678,326, all incorporated herein by reference.

German Pat. No. 1 110 328, incorporated herein by reference, discloses a supporting system for the helical delay line of a travelling wave tube wherein the helix is held by and between three insulating rods which are arranged parallel to the helix axis and wherein at least one unslotted metal ring which presses the insulating rods against the helix is provided. In this system, the inside diameter of the thin-walled metal ring is somewhat smaller than the diameter of the periphery of the helix supporting system and the metal ring consists of a material which is designed so that it is elastically resilient in a radial direction. With the aid of this system it is achieved that only centrally aligned, defined balance forces are exerted on the helix supporting system.

In many travelling wave tubes, a system which consists of, for example, three ceramic (quartz) rods and a plurality of resilient clamping rings which consist of metal and serve to hold together the system, is used for supporting the helical delay line.

The higher the operating frequency of the travelling wave tube the smaller has to be the overall diameter of the tube. Thus the metallic clamping rings come closer and closer to the helical delay line. The clamping rings are then arranged in the high-frequency field of the delay line and therefore produce reflections which are more or less strong and undesired because they lead to resonance effects.

SUMMARY OF THE INVENTION

It is an object of the invention to prevent these undesired reflections in the operating frequency range of the travelling wave tube. In order to realize this object, in a supporting system of the type which is described above, provision has been made for the clamping rings to have a natural length $L_1$ and a distance $L_2$ from one another and to satisfy the condition $$\frac{N \cdot \lambda_w}{4} = L_{1,2} \begin{cases} = L_1 \\ = L_2 \end{cases}$$

respectively where $L_{1,2}$ designates a length of resonant line or resonant section of the delay line, $\lambda_w$ the wave length on the delay line, and N a whole uneven number.

If this condition is adhered to for the center of the operating frequency range no difficulties with undesired, inner reflections arise. The band width obviously depends upon N. A small N results in a large, faultless band width.

The natural length $L_1$ and the distances $L_2$ of the clamping rings are preferably of the same size. Preferably the clamping rings consist of molybdenum or tantalum.

The supporting system in accordance with the invention has the advantage that the natural resonances of the delay line sections between two clamping rings in each case and the natural resonance of the clamping rings itself are prevented in the operating frequency range in that these natural resonances are transferred to other, i.e. non-disturbing frequency ranges. Owing to the fact that the natural length and the distance of the clamping rings is dimensioned in such manner that the undesired resonance effects lie outside the operating range of the tube, a so-called anti-resonance adjustment is obtained.

BRIEF DESCRIPTION OF THE DRAWING

The drawing FIGURE illustrates the travelling wave tube supporting system of the invention.

DESCRIPTION OF THE PREFERRED EMBODIMENTS

In the FIGURE, there is schematically illustrated the sectional view of a supporting system in accordance with the invention for the delay line of a travelling wave tube, parts of which are not shown, but which are well known in the art. The delay line 1 is helical in this exemplary embodiment. The delay line 1 is supported by at least three, and in this exemplary embodiment by four, dielectric support rods 3 which are arranged parallel to one another along generating lines of the line. The support rods 3 consist of, for example, beryllium oxide or aluminum oxide. The support rods 3 are enclosed by a number of clamping rings 2, for example by three clamping rings 2. These clamping rings 2 consist of a resilient material, expediently of molybdenum or tantalum, and press the support rods 3 against the delay line 1. $L_1$, respectively $L_2$ designates the length of the so-called line resonators or resonant sections, namely $L_1$ is the natural length of the clamping rings 2 and $L_2$ the distance between two clamping rings 2 in each case.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A supporting system for a helical or ring-bar delay line of a travelling wave tube, comprising: a delay line held by a plurality of dielectric support rods arranged parallel to one another along generating lines of the delay line; a plurality of clamping rings of resilient material being shaped and positioned to press the support rods against the delay line; and the clamping rings having a natural length $L_1$ in a direction along the delay line and a distance $L_2$ from one another such that $$\frac{N \cdot \lambda_w}{4} = L_{1,2} \begin{cases} = L_1 \\ = L_2 \end{cases} \text{respectively}$$

where $L_{1,2}$ designates the length of resonance sections or line resonators of the line, $\lambda_w$ the wave length on the delay line, and N a whole uneven number (1,3 . . . N).

2. A supporting system as claimed in claim 1 wherein said natural length of the clamping rings $L_1$ and said distance $L_2$ between the clamping rings are equal to one another.

3. A supporting system of claim 1 wherein the clamping rings are comprised of molybdenum or tantalum.

* * * * *